US010277972B2

(12) United States Patent
Liu et al.

(10) Patent No.: US 10,277,972 B2
(45) Date of Patent: Apr. 30, 2019

(54) HEADPHONE AND INTERACTION SYSTEM

(71) Applicant: SHENZHEN GOODIX TECHNOLOGY CO., LTD., Shenzhen (CN)

(72) Inventors: Chang Liu, Shenzhen (CN); Wangwang Yang, Shenzhen (CN); Hongliang Duan, Shenzhen (CN); Gengchun Deng, Shenzhen (CN); Haixiang Wang, Shenzhen (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/693,477

(22) Filed: Sep. 1, 2017

(65) Prior Publication Data

US 2018/0027320 A1 Jan. 25, 2018

Related U.S. Application Data

(63) Continuation of application No. PCT/CN2016/090604, filed on Jul. 20, 2016.

(51) Int. Cl.
*H04R 1/10* (2006.01)
*G10L 19/00* (2013.01)
(Continued)

(52) U.S. Cl.
CPC ..... *H04R 1/1041* (2013.01); *G10L 19/00* (2013.01); *H04R 1/1058* (2013.01);
(Continued)

(58) Field of Classification Search
CPC ..... H04R 1/10; H04R 1/1041; H04R 1/1066; H04R 1/105; H04R 2420/09; G10L 19/00;
(Continued)

(56) References Cited

U.S. PATENT DOCUMENTS 8,295,567 B2 * 10/2012 Watson ..... A61B 5/0816 381/94.1
2005/0197552 A1 * 9/2005 Baker, Jr. ..... A61B 5/02416 600/324
(Continued)

FOREIGN PATENT DOCUMENTS

CN 104080028 A 10/2014
CN 105120404 A 12/2015
(Continued)

OTHER PUBLICATIONS

Robert Triggs, "3.5mm Audio vs USB Type-C: the good, bad and the future," https://www.androidauthority.com/3-5mm-audio-usb-type-c-701507/, Jul. 12, 2016, 10 pages total.

*Primary Examiner* — Ahmad F. Matar
*Assistant Examiner* — Sabrina Diaz

(57) ABSTRACT

Embodiments of the present disclosure provide a headphone and an interaction system. The headphone includes: a controller electrically connected to the Type-C interface, a biological features detection module connected to the controller, a microphone electrically connected to the controller, and a loudspeaker electrically connected to the controller. The biological features detection module is configured to detect biological features of a user wearing the headphone; and the controller is configured to control paring between the Type-C interface and a terminal and communication between the terminal and the biological features detection module, the microphone and the loudspeaker when the headphone is in a digital mode, to control detection of biological features and processing of audio data.

20 Claims, 6 Drawing Sheets

(51) Int. Cl.

| | |
|---|---|
| *F21Y 115/10* | (2016.01) |
| *F21V 23/00* | (2015.01) |
| *F21V 33/00* | (2006.01) |

(52) U.S. Cl.
CPC ..... *F21V 23/003* (2013.01); *F21V 33/0056* (2013.01); *F21Y 2115/10* (2016.08); *H04R 2201/107* (2013.01); *H04R 2420/09* (2013.01)

(58) Field of Classification Search
CPC . F21V 33/0056; F21V 23/003; F21Y 2115/10
USPC ..... 381/74
See application file for complete search history.

(56) References Cited

U.S. PATENT DOCUMENTS

| | | | | |
|---|---|---|---|---|
| 2016/0094906 | A1 | 3/2016 | Keskin et al. | |
| 2016/0154622 | A1 | 6/2016 | Zwart | |
| 2016/0246747 | A1* | 8/2016 | Rand | G06F 13/385 |
| 2016/0269193 | A1* | 9/2016 | Zwart | G06F 13/4291 |

FOREIGN PATENT DOCUMENTS

| | | | |
|---|---|---|---|
| CN | 105451115 | A | 3/2016 |
| CN | 105491483 | A | 4/2016 |
| CN | 105554611 | A | 5/2016 |
| EP | 2728899 | A2 | 5/2014 |
| WO | 2016046550 | A | 3/2016 |

* cited by examiner

HEADPHONE AND INTERACTION SYSTEM

CROSS-REFERENCE TO RELATED APPLICATIONS

This application is a continuation of International Patent Application No. PCT/CN2016/090604, with an international filing date of Jul. 20, 2016, which is hereby incorporated by reference in its entirety.

TECHNICAL FIELD

Embodiments of the present disclosure relate to the field of wearable devices, and in particular, relate to a headphone and an interaction system.

BACKGROUND

Headphones are an entertainment tool which is frequently used by people, and are small in size and convenient to wear. Therefore, the headphones are widely used in people's life and work. For example, people may listen to music via the headphones while they are doing morning exercise, and may wear the headphones to watch videos, enjoy music and practice their English listening when they are going to work or going home after work.

However, with the development and advancement of science and technology, the function of the headphone is not limited to the single function of a traditional headphone. Smart headphones are nowadays being used among people. For example, smart headphones capable of detecting heart rate information of human bodies by detecting vibration at the auricle are well populated.

The biological features may be categorized into physiological features (for example, fingerprint, face image, iris, palm print and the like) and behavior features (for example, gait, voice, handwriting and the like). The biological features detection signifies identification and identity authentication of an individual based on the unique biological features of the individual.

At present, during practice of biological features detection and identification using the headphone in the related art, the headphone is connected to a smart terminal such as a mobile phone, and enables the biological features detection function upon receiving an instruction of the smart terminal. However, during practice of the present disclosure, the inventors have found that the interaction between the smart terminal and the headphone is mainly based on a 3.5 mm headphone interface in the related art, and only the analog audio protocol may be implemented. Therefore, the extensibility is poor, and if biological features detection needs to be implemented using the headphone, the headphone may only be inserted into a dedicated headphone socket of the smart terminal such as the mobile phone and the like.

SUMMARY

Embodiments of the present disclosure are intended to provide a headphone and an interaction system, to at least solve the above technical problem in the related art.

To achieve the objective of embodiments of the present disclosure, embodiments of the present disclosure provide a headphone. The headphone includes: a controller electrically connected to a Type-C interface, a biological features detection module connected to the controller, a microphone electrically connected to the controller, and a loudspeaker electrically connected to the controller. The biological features detection module is configured to detect biological features of a user wearing the headphone; and the controller is configured to control paring between the Type-C interface and a terminal and communication between the terminal and the biological features detection module, the microphone and the loudspeaker when the headphone is in a digital mode, to control detection of biological features and processing of audio data.

Embodiments of the present disclosure further provide an interaction system. The interaction system includes a smart terminal and the headphone as defined in any of the above embodiments. Processing of audio and video data and detection of biological features by the biological features detection module in the headphone are triggered by connecting the Type-C interface in the headphone to the smart terminal.

The present disclosure has the following technical advantages:

The headphone includes: a Type-C interface, a controller electrically connected to the Type-C interface, a processor connected to the controller, a microphone electrically connected to the processor, and a loudspeaker electrically connected to the processor. The processor includes a biological features detection module. The biological features detection module is configured to detect biological features of a user wearing the headphone; and the controller is configured to control communication between the Type-C interface and the processor to control detection of biological features and processing of audio and video data. Since the Type-C interface not only supports analog communication, but also supports digital communication and analog-digital hybrid communication, no dedicated headphone socket is needed during practice of biological features detection using the headphone; instead, the Type-C interface may be directly used, which optimizes extensibility of the headphone.

DETAILED DESCRIPTION

Practice of the present application is described in detail with reference to drawings and specific embodiments, such that the practice of addressing the technical problem using the technical means according to the present application and achieving the technical effects may be better understood and conducted.

In the embodiments of the present disclosure hereinafter, a headphone includes: a Type-C interface, a controller electrically connected to the Type-C interface, a biological features detection module connected to the controller, a microphone electrically connected to the controller, and a loudspeaker electrically connected to the controller. The biological features detection module is configured to detect biological features of a user wearing the headphone; and the controller is configured to control paring between the Type-C interface and a terminal and communication between the terminal and the biological features detection module, the microphone and the loudspeaker when the headphone is in a digital mode, to control detection of biological features and processing of audio and video data. Since the Type-C interface not only supports analog communication, but also supports digital communication and analog-digital hybrid communication, no dedicated headphone socket, is needed during detecting biological features with the headphone; instead, the Type-C interface may be directly used, which optimizes extensibility of the headphone.

Figure 1:
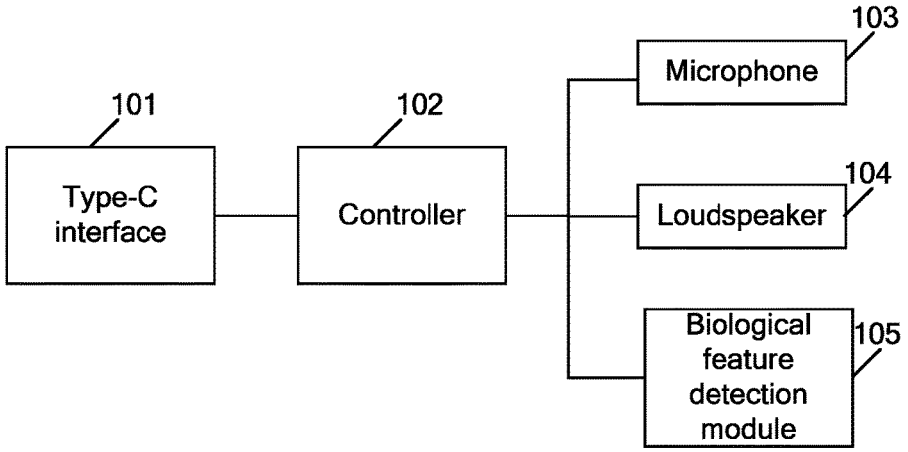
FIG. 1 is a schematic structural diagram of a headphone according to Embodiment 1 of the present disclosure.

FIG. 1 is a schematic structural diagram of a headphone according to Embodiment 1 of the present disclosure. As illustrated in FIG. 1, the headphone includes: a Type-C interface 101, a controller 102 electrically connected to the Type-C interface 101, a biological features detection module 105 connected to the controller 102, a microphone 103 electrically connected to the controller, and a loudspeaker 104 electrically connected to the controller. The biological features detection module 105 is configured to detect biological features of a user wearing the headphone; and the controller 102 is configured to control paring between the Type-C interface 101 and a terminal and communication between the biological features detection module 105, the microphone 103 and the loudspeaker 104 when the headphone is in a digital mode, to control detection of biological features and processing of audio and video data to match the microphone 103 and the left and right amplifiers.

In this embodiment, the Type-C interface and the terminal are paired, such that the headphone and the terminal may identify each other and data may be transmitted there between.

In this embodiment, a plurality of biological features may be detected, for example, heart rate, step counting, body temperature, blood oxygen and the like. The duration of detecting biological features may involve monitoring biological features and parsing the monitored biological features.

In this embodiment, the microphone 103 may be configured to acquire sounds which may be audio and video analog signals; the loudspeaker 104 is configured to play the sounds, for example, when the headphone is connected to a smart terminal, the loudspeaker could be configured to play music or voice interactions for instant communication or the like, and convert digital signals corresponding to the music to audio and video analog signals to play, or convert the acquired audio and video analog signals by means of analog-to-digital conversion and digital-to-analog conversion to audio and video analog signals to play, which is not described herein any further.

In this embodiment, when the headphone is connected to a smart terminal, for example, in a wireless manner or in a wired manner, according to a control instruction of the smart terminal, the biological features detection module 105 is triggered to perform detection of biological features. The control instruction may be a voice control instruction, a mechanical key control instruction or the like, which is not described herein any further.

Figure 2:
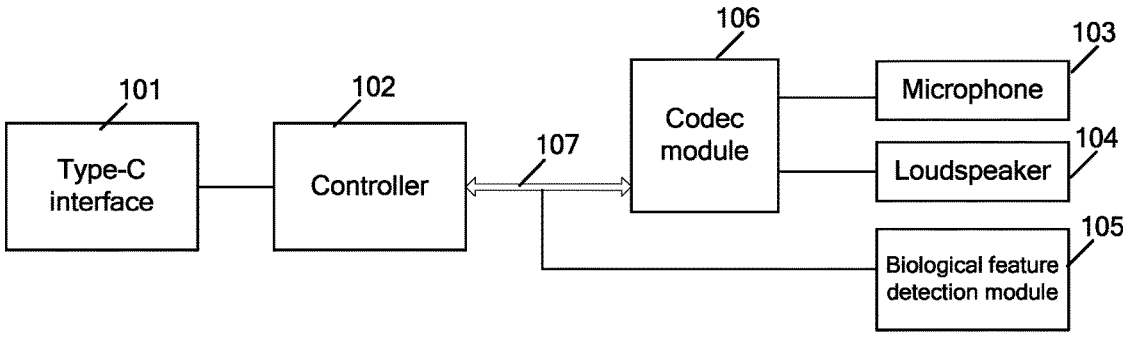
FIG. 2 is a schematic structural diagram of a headphone according to Embodiment 2 of the present disclosure.

FIG. 2 is a schematic structural diagram of a headphone according to Embodiment 2 of the present disclosure. As illustrated in FIG. 2, different from Embodiment 1, in this embodiment, the headphone further includes a codec module 106. The codec module 106 is configured to communicate with the controller 102 via a first digital channel 107, and is configured to process audio and video analog signals and process audio and video digital signals; and the controller 102 is configured to communicate with the biological features detection module 105 by the first digital channel 107, to control detection of biological features.

In this embodiment, using a headphone based on the audio and video digital communication protocol as an example, when audio and video digital signals need to be played by the headphone, a connection is established between the first digital channel 107 and the codec module 106, to control process of audio and video digital data to match the microphone 103 and the loudspeaker 104. For example, when the headphone is connected to the smart terminal, music or voice interactions for instant communication or the like are played, and digital signals corresponding to the music are converted into audio and video analog signals and are then amplified to play by the loudspeaker 104; or audio and video analog signals acquired using the microphone 103 are converted by means of analog-to-digital conversion and digital-to-analog conversion to audio and video analog signals and are then amplified to play using the loudspeaker 104, which is not described herein any further.

In this embodiment, when the headphone is connected to a smart terminal, for example, in a wireless manner or in a wired manner, according to a control instruction of the smart terminal, when the biological features detection module 105 is triggered to perform detection of biological features, the controller 102 is connected to the biological features detection module 105 by the first digital channel 107, to control detection of biological features.

In this embodiment, the first digital channel 107 may be multiplexed by using a multiplexing switch, which is not described herein any further. The microphone 103 is connected to the codec module 106 via a wire of the microphone 103, and the loudspeaker 104 is connected to the codec module 106 via left and right sound channel wires, which is not described herein any further.

In this embodiment, the codec module may directly be configured to communicate with the controller via the first digital channel, so as to process the audio and video analog signals and process the audio and video digital signals. During practice of biological features detection, the controller is configured to communicate with the biological features detection module by the first digital channel.

Figure 3:
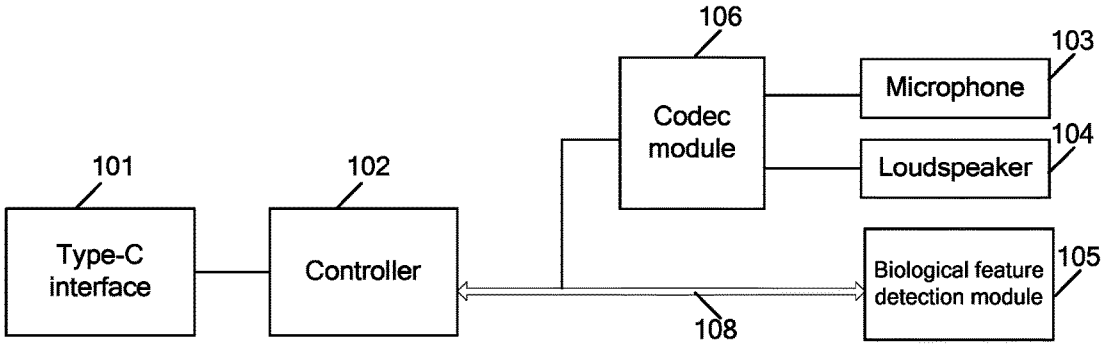
FIG. 3 is a schematic structural diagram of a headphone according to Embodiment 3 of the present disclosure.

FIG. 3 is a schematic structural diagram of a headphone according to Embodiment 3 of the present disclosure. As illustrated in FIG. 3, different from Embodiment 1, in this embodiment, the controller 102 is configured to communicate with the biological features detection module 105 via a second digital channel 108, to control detection of biological features and processing of audio and video data to match the microphone 103 and the loudspeaker 104. The headphone further includes a codec module 106. The codec module 106 is configured to communicate with the controller 102 by the second digital channel 108, and is configured to process audio and video analog signals and process audio and video digital signals.

In this embodiment, using a headphone based on audio and video digital communication protocol as an example, when the headphone is connected to a smart terminal, for example, in a wireless manner or in a wired manner, according to a control instruction of the smart terminal, if the biological features detection module 105 is triggered to perform detection of biological features, the controller 102 is connected to the biological features detection module 105 by the second digital channel 108, to control detection of biological features. When audio and video digital signals need to be played using the headphone, the second digital channel 108 is multiplexed to establish a connection with the codec module 106, to control processing of audio and video digital data to match the microphone 103 and the loudspeaker 104. For example, when the headphone is connected to the smart terminal, music or voice interactions for instant communication or the like are played, and digital signals corresponding to the music are converted into audio and video analog signals and are then amplified to play using the loudspeaker 104; or audio and video analog signals acquired using the microphone 103 are converted by means of analog-to-digital conversion and digital-to-analog conversion to audio and video analog signals and are then amplified to play using the loudspeaker 104, which is not described herein any further.

In this embodiment, the second digital channel 108 may be multiplexed by using a multiplexing switch, which is not described herein any further.

In this embodiment, during practice of biological features detection, the controller directly is configured to communicate with the biological features detection module via the first digital channel; and during practice of processing audio and video analog signals and processing of audio and video digital signals, the codec module may be configured to communicate with the controller via the first digital channel.

Figure 4:
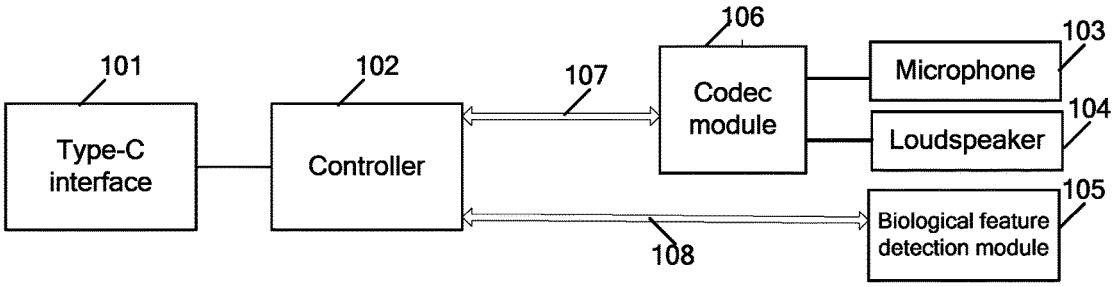
FIG. 4 is a schematic structural diagram of a headphone according to Embodiment 4 of the present disclosure.

FIG. 4 is a schematic structural diagram of a headphone according to Embodiment 4 of the present disclosure. As illustrated in FIG. 4, different from Embodiment 1, in this embodiment, the processor further includes a codec module 106. The codec module 106 is configured to communicate with the controller 102 via a first digital channel 107, and is configured to process audio and video analog signals and process audio and video digital signals; and the controller 102 is configured to communicate with the biological features detection module 105 via a second digital channel 108, to control detection of biological features and processing of audio and video data to match the microphone 103 and the loudspeaker 104.

In this embodiment, using a headphone based on the audio and video digital communication protocol as an example, when audio and video digital signals need to be played using the headphone, a connection is established between the first digital channel 107 and the codec module 106, to control process of audio and video digital data to match the microphone 103 and the loudspeaker 104. For example, when the headphone is connected to the smart terminal, music or voice interactions for instant communication or the like are played, and digital signals corresponding to the music are converted into audio and video analog signals and are then amplified to play by the loudspeaker 104; or audio and video analog signals acquired using the microphone 103 are converted by means of analog-to-digital conversion and digital-to-analog conversion to audio and video analog signals and are then amplified to play using the loudspeaker 104, which is not described herein any further.

In this embodiment, when the headphone is connected to a smart terminal, for example, in a wireless manner or in a wired manner, according to a control instruction of the smart terminal, when the biological features detection module 105 is triggered to perform detection of biological features, the controller 102 is connected to the biological features detection module 105 via the second digital channel 108, to control detection of biological features.

In another embodiment, based on the embodiments as illustrated in FIG. 1 to FIG. 4, optionally, the Type-C interface 101 includes a first pin. The first pin is electrically connected to the controller 102, and is configured to supply power to the controller 102, the microphone 103 and the loudspeaker 104.

In another embodiment, based on the embodiments as illustrated in FIG. 1 to FIG. 4, optionally, the Type-C interface 101 includes a second pin. The second pin is electrically connected to the controller 102, and is configured to carry out communication between paring the headphone and the terminal using the headphone.

In another embodiment, based on the embodiments as illustrated in FIG. 1 to FIG. 4, optionally, the Type-C interface 101 includes a third pin. The third pin is electrically connected to the biological features detection features 105, and is configured to supply power to the biological features detection module 105.

In another embodiment, based on the embodiments as illustrated in FIG. 1 to FIG. 4, optionally, the Type-C interface 101 includes a plurality of fourth pins. The fourth pin is electrically connected to the controller 102, and is configured to carry out communication between the Type-C interface 101 and the biological features detection module 105, the microphone 103 and the loudspeaker 104.

Figure 5:
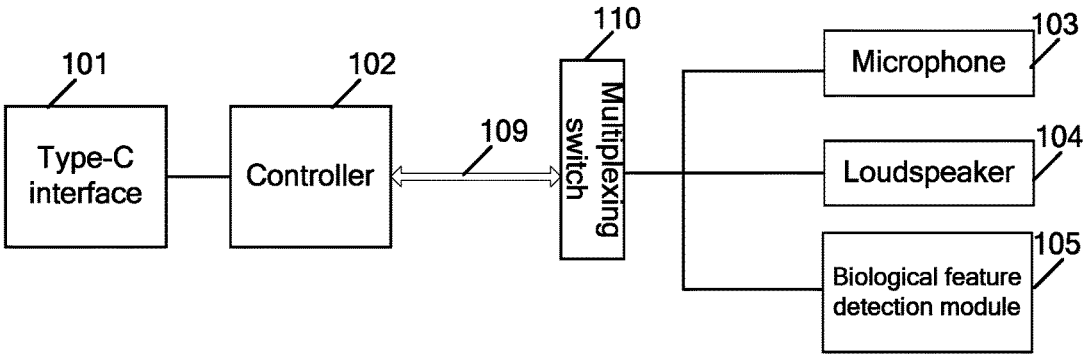
FIG. 5 is a schematic structural diagram of a headphone according to Embodiment 5 of the present disclosure.

FIG. 5 is a schematic structural diagram of a headphone according to Embodiment 5 of the present disclosure. As illustrated in FIG. 5, different from Embodiment 1, in this embodiment, the headphone further includes a first analog channel 109, and the controller 102 is electrically connected to the biological features detection module 105, the microphone 103 and the loudspeaker 104 via the first analog channel 109, to control detection of biological features and processing of audio and video data to match the microphone 103 and the loudspeaker 104.

Optionally, in this embodiment or any other embodiment, the headphone further includes a multiplexing switch 110. The multiplexing switch 110 is configured to control the biological features detection module 105, the microphone 103 and the loudspeaker 104 via multiplex the same first analog channel 109.

Optionally, in any embodiment of the present disclosure, a signal wire corresponding to the microphone 103 is multiplexed to supply power to the biological features detection module 105, and carry out uplink communication of the biological features detection module 105; and left and right sound channel wires corresponding to the loudspeaker 104 are multiplexed to carry out downlink communication of the biological features detection module 105. The uplink communication includes uploading detected biological features data and the like to the terminal such as a mobile phone and the like, and the downlink communication includes sending a control instruction and the like to the biological features detection module 105 by the terminal such as a mobile phone via the controller 102.

When audio and video analog signals need to be played using the headphone, the first analog channel 109 is connected to the microphone 103 and the loudspeaker 104. For example, when the headphone is connected to the smart terminal, music or voice interactions for instant communication or the like are played, and digital signals corresponding to the music are converted into audio and video analog signals and are then amplified to play using the loudspeaker 104; or audio and video analog signals acquired using the microphone 103 are converted by means of analog-to-digital conversion and digital-to-analog conversion to audio and video analog signals and are then amplified to play using the loudspeaker 104, which is not described herein any further.

In this embodiment, when the headphone is connected to a smart terminal, for example, in a wireless manner or in a wired manner, according to a control instruction of the smart terminal, when the biological features detection module 105 is triggered to perform detection of biological features, the controller 102 is connected to the biological features detection module 105 via the first analog channel 109, to control detection of biological features.

In another embodiment, based on the embodiment as illustrated in FIG. 5, optionally, the Type-C interface 101 includes a fourth pin and a fifth pin. The fourth pin and the fifth pin are respectively pulled down to the ground via a first pull-down resistor and a second pull-down resistor, such that the headphone is in an analog mode.

In another embodiment, based on the embodiment as illustrated in FIG. 5, optionally, the Type-C interface 101 includes a plurality of sixth pins. The sixth pin is connected to the first analog channel 109 via the controller 102, and is configured to carry out communication between the Type-C interface 101 and the biological features detection module 105, the microphone 103 and the loudspeaker 104.

Figure 6:
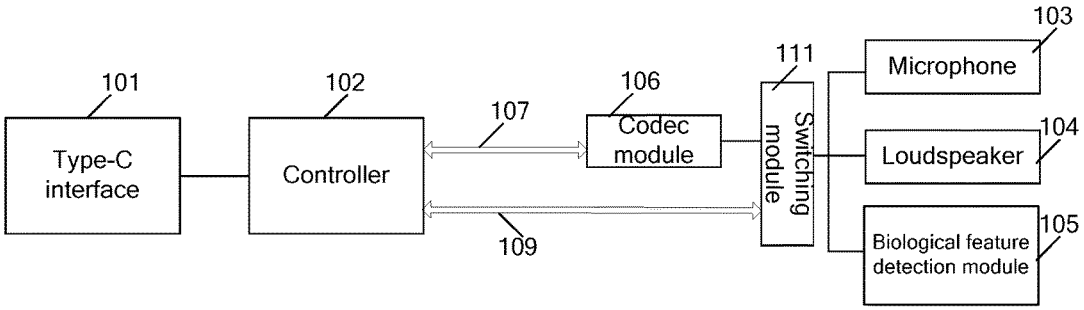
FIG. 6 is a schematic structural diagram of a headphone according to Embodiment 6 of the present disclosure.

FIG. 6 is a schematic structural diagram of a headphone according to Embodiment 6 of the present disclosure. As illustrated in FIG. 6, in this embodiment, the headphone further includes a first analog channel 109, and the controller 102 is electrically connected to the biological features detection module 105, the microphone 103 and the loudspeaker 104 via the first analog channel 109, to control detection of biological features and processing of audio and video data to match the microphone 103 and the loudspeaker 104.

The headphone further includes a codec module 106. The codec module 106 is configured to communicate with the controller 102 via a first digital channel 107, and is configured to process audio and video analog signals and process audio and video digital signals; and the controller 102 is configured to communicate with the biological features detection module 105 by the first digital channel 107, to control detection of biological features.

The headphone further includes a switching module. The switching module is configured to switch to detect of biological features and process audio and video data by the first analog channel 109 or the first digital channel 107, so as to match the microphone 103 and the loudspeaker 104.

In this embodiment, switching of the first analog channel and the first digital channel is controlled by using the switching module, thereby implementing transmission of both digital audio protocol and analog audio. In the aspect of audios, such devices as mobile phones and the like that are equipped with a built-in Hi-Fi module or supports analog audio output may employ analog audio transmission, and such devices as mobile phone and the like that support the digital audio protocol may employ digital audio transmission.

Figure 7:
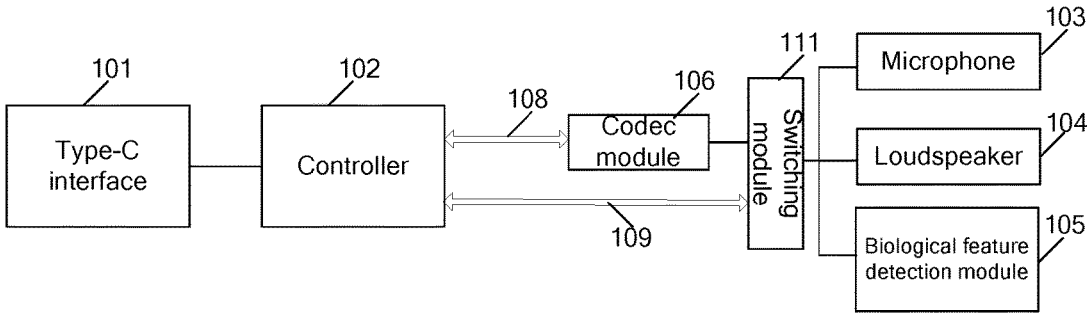
FIG. 7 is a schematic structural diagram of a headphone according to Embodiment 7 of the present disclosure.

FIG. 7 is a schematic structural diagram of a headphone according to Embodiment 7 of the present disclosure. As illustrated in FIG. 7, using a hybrid configuration of the audio and video digital communication protocol and the audio and video analog communication protocol as an example, the headphone further includes a first analog channel 109. The controller 102 is electrically connected to the biological features detection module 105, the microphone 103 and the loudspeaker 104 via the first analog channel 109, to control detection of biological features and processing of audio and video data to match the microphone 103 and the loudspeaker 104. The controller 102 is configured to communicate with the biological features detection module 105 via a second digital channel 108, to control detection of biological features and processing of audio and video data to match the microphone 103 and the loudspeaker 104.

The headphone further includes a codec module 106. The codec module 106 is configured to communicate with the controller 102 by the second digital channel 108 and is configured to process audio and video analog signals and process audio and video digital signals.

The headphone further includes a switching module. The switching module is configured to switch to detect biological features and process audio and video data by the first analog channel 109 or the second digital channel 108, so as to match the microphone 103 and the loudspeaker 104.

In this embodiment, switching of the first analog channel and the second digital channel is controlled by using the switching module, thereby implementing transmission of both digital audio protocol and analog audio. In the aspect of audios, such devices as mobile phones and the like that are equipped with a built-in Hi-Fi module or supports analog audio output may employ analog audio transmission, and such devices as mobile phone and the like that support the digital audio protocol may employ digital audio transmission.

Figure 8:
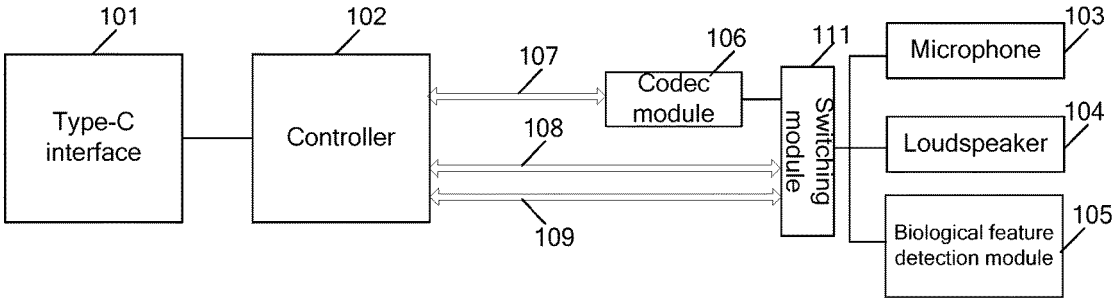
FIG. 8 is a schematic structural diagram of a headphone according to Embodiment 8 of the present disclosure.

FIG. 8 is a schematic structural diagram of a headphone according to Embodiment 8 of the present disclosure. As illustrated in FIG. 8, using a hybrid configuration of the audio and video digital communication protocol and the audio and video analog communication protocol as an example, the processor further includes a codec module 106. The codec module 106 communicates with the controller 102 via a first digital channel 107, and is configured to process audio and video analog signals and process audio and video digital signals. The controller 102 is configured to communicate with the biological features detection module 105 via a second digital channel 108, to control detection of biological features and processing of audio and video data to match the microphone 103 and the loudspeaker 104.

The headphone further includes a first analog channel 109. The controller 102 is electrically connected to the biological features detection module 105, the microphone 103 and the loudspeaker 104 via the first analog channel 109, to control detection of biological features and processing of audio and video data to match the microphone 103 and the loudspeaker 104.

The headphone further includes a switching module. The switching module is configured to switch to detect biological features and process audio and video data by the first analog channel 109 or the first/second digital channel, so as to match the microphone 103 and the loudspeaker 104.

In this embodiment, switching of the first analog channel and the first/second digital channel is controlled by using the switching module, thereby implementing transmission of both digital audio protocol and analog audio. In the aspect of audios, such devices as mobile phones and the like that are equipped with a built-in Hi-Fi module or supports analog audio output may employ analog audio transmission, and such devices as mobile phone and the like that support the digital audio protocol may employ digital audio transmission.

Figure 9:
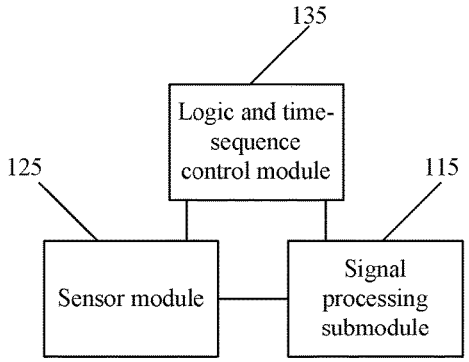
FIG. 9 is a schematic structural diagram of a biological features detection module according to Embodiment 9 of the present disclosure.

FIG. 9 is a schematic structural diagram of a biological features detection module according to Embodiment 9 of the present disclosure. As illustrated in FIG. 9, the biological features detection module includes a signal processing submodule 115 and a sensor module 125. The sensor module is configured to detect the biological features; and the signal processing submodule 115 is configured to acquire the detected biological features and process the acquired biological features.

Optionally, in this embodiment, further including a logic and time-sequence control module 135, configured to perform time-sequence control on the sensor module and the signal processing submodule 115.

Figure 10:
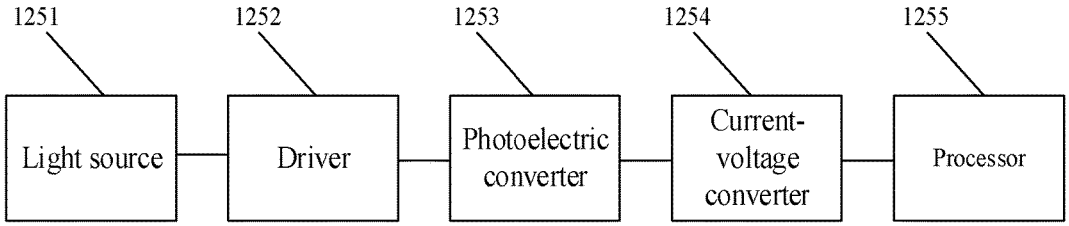
FIG. 10 is a schematic structural diagram of a sensor module according to Embodiment 10 of the present disclosure.

FIG. 10 is a schematic structural diagram of a sensor module according to Embodiment 10 of the present disclosure. As illustrated in FIG. 10, the sensor module includes: a light source 1251 configured to irradiate a detected region, a driver 1252 configured to drive the light source to emit light, an photoelectric converter 1253 configured to receive an optical signal reflected by the detected region and convert the optical signal into a current signal, a current-voltage converter 1254 configured to convert the current signal into a voltage signal, and a processor 1255 configured to process the voltage signal.

Figure 11:
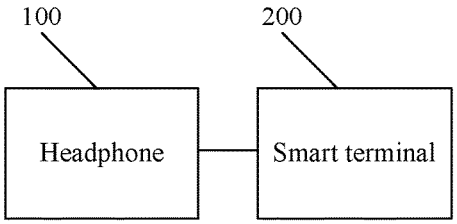
FIG. 11 is a schematic structural diagram of an interaction system according to Embodiment 11 of the present disclosure.

FIG. 11 is a schematic structural diagram of an interaction system according to Embodiment 11 of the present disclosure. As illustrated in FIG. 10, the interaction system includes a smart terminal 200 and a headphone 100 as described in any of the above embodiments. Processing of audio and video data and detection of biological features by the biological features detection module in the headphone are triggered by connecting the Type-C interface in the headphone to the smart terminal 200.

Figure 12:
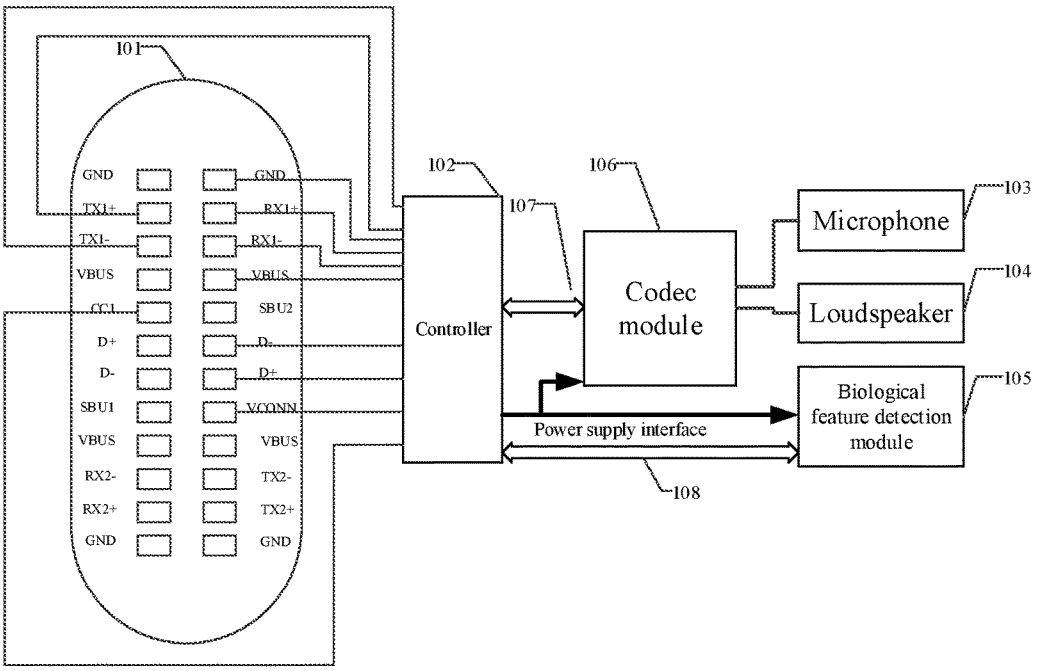
FIG. 12 is a schematic structural diagram of a headphone according to Embodiment 12 of the present disclosure.

FIG. 12 is a schematic structural diagram of a headphone according to Embodiment 12 of the present disclosure. As illustrated in FIG. 12, corresponding to the specific implementation manner as illustrated in FIG. 4, in this embodiment, the processor further includes a codec module 106. The codec module 106 is configured to communicate with the controller 102 via a first digital channel 107, and is configured to process audio and video analog signals and process audio and video digital signals; and the controller 102 is configured to communicate with the biological features detection module 105 via a second digital channel 108, to control detection of biological features and processing of audio and video data to match the microphone 103 and the loudspeaker 104 to match the microphone 103 and the loudspeaker 104.

In this embodiment, the Type-C interface 101 is a Type-C male connector, and may specifically includes totally 24 pins including a Type-C male connector 101 (an connector between a headphone and a terminal device) supporting the USB interface, a Vconn pin, a D1+ pin, a D1− pin, a D2+ pin, a D2− pin, four VBUS pins, four GND pins, a CC1 pin, a CC2 pin (multiplexing the Vconn pin), a SBU1 pin, a SBU2 pin, an RX1+ pin, an RX1− pin, an RX2+ pin, an RX2− pin, a TX1+ pin, a TX1− pin, a TX2+ pin, a TX2− pin that are specified in the protocol of the Type-C interface 101. The D1+ pin, the D1− pin, the D2+ pin and the D2− pin are two pairs of D+s and D−s in the drawing.

In this embodiment, the CC2 pin of the Type-C interface 101 is configured to the Vconn pin and electrically connected to the controller 102, and is configured to supply power to the controller 102, the biological features detection module 105, the microphone 103 and the loudspeaker 104.

In this embodiment, the CC1 pin of the Type-C interface 101 is electrically connected to the controller 102, and is configured to carry out communication for paring the headphone and the terminal using the headphone.

In this embodiment, the VBUS pin of the Type-C interface 101 is electrically connected to the processor and the codec module 106 via the controller 102, and is configured to supply power to the biological features detection module 105 and the codec module 106.

In this embodiment, the TX1+, TX1−, RX1+, RX1−, D+ and D− pins of the Type-C interface 101 are electrically connected to the controller 102, and are configured to carry out communication between the Type-C interface 101 and the biological features detection module 105, the microphone 103 and the loudspeaker 104.

Figure 13:
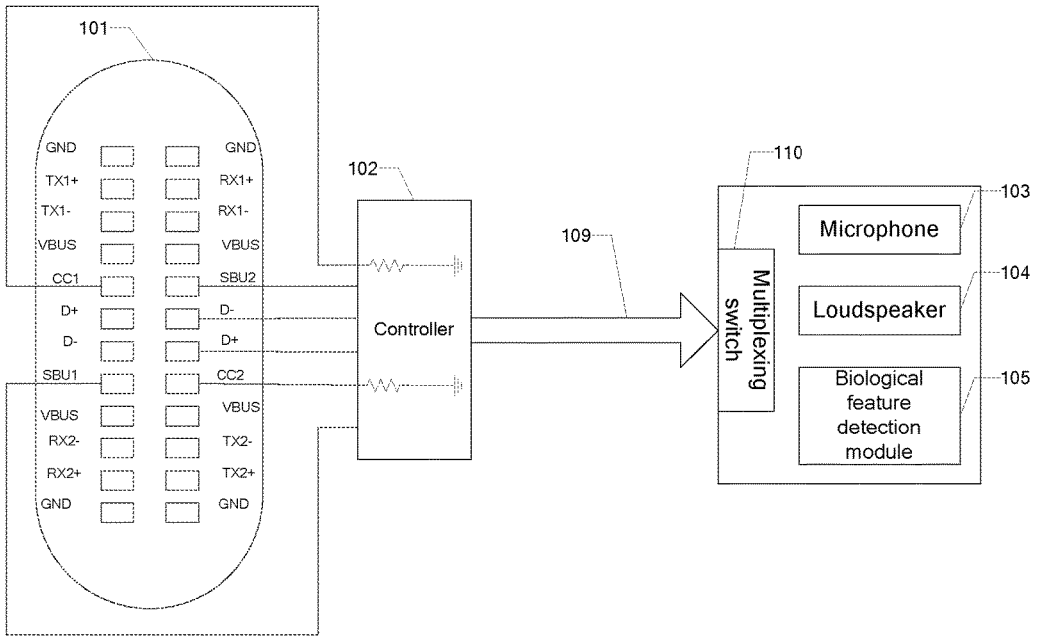
FIG. 13 is a schematic structural diagram of a headphone according to Embodiment 13 of the present disclosure.

FIG. 13 is a schematic structural diagram of a headphone according to Embodiment 13 of the present disclosure. As illustrated in FIG. 13, in this embodiment, the headphone further includes a first analog channel 109, and the controller 102 is electrically connected to the biological features detection module 105, the microphone 103 and the loudspeaker 104 via the first analog channel 109, to control detection of biological features and processing of audio and video data to match the microphone 103 and the loudspeaker 104.

In this embodiment, the multiplexing switch 110 is configured to control the biological features detection module 105, the microphone 103 and the loudspeaker 104 to multiplex the same first analog channel 109.

In this embodiment, a signal wire corresponding to the microphone 103 is multiplexed to supply power to the biological features detection module 105, and carry out uplink communication of the biological features detection module 105; and left and right sound channel wires corresponding to the loudspeaker 104 are multiplexed to carry out downlink communication of the biological features detection module 105. Specifically, the first analog channel 109 may include a wire of the microphone 103, two sound channel wires, and a ground wire; the loudspeaker 104 is electrically connected to the two sound channel wires; and the microphone 103 is electrically connected to the wire of the microphone 103.

Like Embodiment 12 as described above, in this embodiment, the Type-C interface is a Type-C male connector, and may specifically includes totally 24 pins including a Type-C male connector 101 (an connector between a headphone and a terminal device) supporting the USB interface, a Vconn pin, a D1+ pin, a D1− pin, a D2+ pin, a D2− pin, four VBUS pins, four GND pins, a CC1 pin, a CC2 pin, a SBU1 pin, a SBU2 pin, an RX1+ pin, an RX1− pin, an RX2+ pin, an RX2− pin, a TX1+ pin, a TX1− pin, a TX2+ pin, a TX2− pin that are specified in the protocol of the Type-C interface 101. The D1+ pin, the D1− pin, the D2+ pin and the D2− pin are two pairs of D+s and D−s in the drawing.

In this embodiment, the CC1 pin and the CC2 pin of the Type-C interface 101 are pulled down to the ground via a first pull-down resistor and a second pull-down resistor, such that the headphone is in an analog mode.

In this embodiment, the GND, CC1, CC2, SBU1, SBU2, D+ and D− pins of the Type-C interface 101 are electrically connected to the first analog channel 109 via the controller 102, and are configured to carry out communication between the Type-C interface 101 and the biological features detection module 105, the microphone 103 and the loudspeaker 104.

Figure 14:
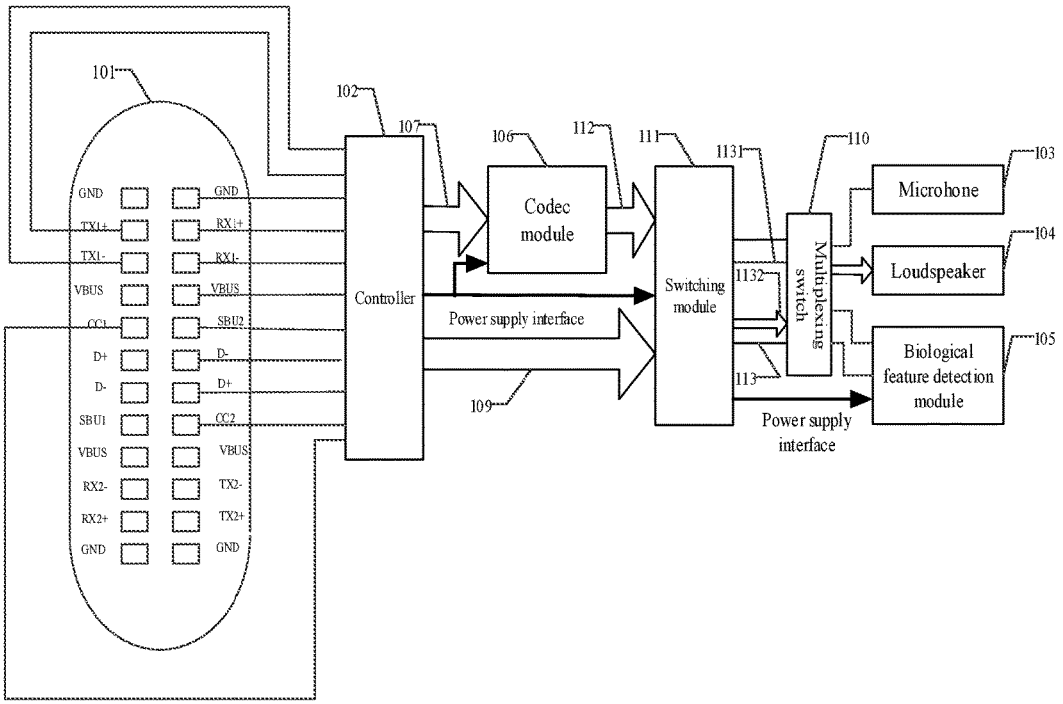
FIG. 14 is a schematic structural diagram of a headphone according to Embodiment 14 of the present disclosure.

FIG. 14 is a schematic structural diagram of a headphone according to Embodiment 14 of the present disclosure. As illustrated in FIG. 14, in this embodiment, the headphone further includes a codec module 106. The codec module 106 is configured to communicate with the controller 102 via a first digital channel 107, and is configured to process audio and video analog signals and process audio and video digital signals.

The headphone further includes a first analog channel 109. The controller 102 is electrically connected to the biological features detection module 105, the microphone 103 and the loudspeaker 104 via the first analog channel 109, to control detection of biological features and processing of audio and video data to match the microphone 103 and the loudspeaker 104.

The headphone further includes a switching module 111. The switching module 111 is configured to switch to detect biological features and process audio and video data by the analog channel or the first digital channel, so as to match the microphone 103 and the loudspeaker 104. The codec module 106 is configured to communicate with the switching module 111 via a second analog channel 112.

In this embodiment, the multiplexing switch 110 is configured to control the biological features detection module 105, the microphone 103 and the loudspeaker to multiplex the same third analog channel 113. The switching module is connected to the multiplexing switch 110 via the third analog channel 113. The third analog channel 113 includes a microphone wire 1131 and two sound channel wires 1132, and the two sound channel wires 1132 correspond to the left and right sound channel.

In a digital headphone mode, the second analog channel 112 is connected to the microphone wire 1131 and the two sound channel wires 1132; and in an analog headphone mode, the first analog channel 109 is connected to the microphone wire 1131 and the two sound channel wires 1132.

When the audio and video digital communication protocol is used, in this embodiment, the CC2 pin of the Type-C interface 101 is configured to the Vconn pin and connected to the controller 102, and is configured to supply power to the controller 102. The CC1 pin of the Type-C interface 101 is electrically connected to the controller 102, and is configured to carry out communication for paring the headphone and the terminal using the headphone. The VBUS pin of the Type-C interface 101 is electrically connected to the biological features detection module 105 and the codec module 106 via the controller 102, and is configured to supply power to the biological features detection module 105 and the codec module 106. The TX1+, RX1+, D+ and D− pins of the Type-C interface 101 are electrically connected to the controller 102, and are configured to carry out communication between the Type-C interface 101 and the processor.

When the audio and video analog communication protocol is used, in this embodiment, the CC1 pin and the CC2 pin of the Type-C interface 101 are pulled down to the ground via a first pull-down resistor and a second pull-down resistor respectively. The SBU1, SBU2, D+ and D− pins of the Type-C interface 101 are electrically connected to a first analog channel 109 via the controller 102, and are configured to carry out communication between the Type-C interface 101 and the processor.

Figure 15:
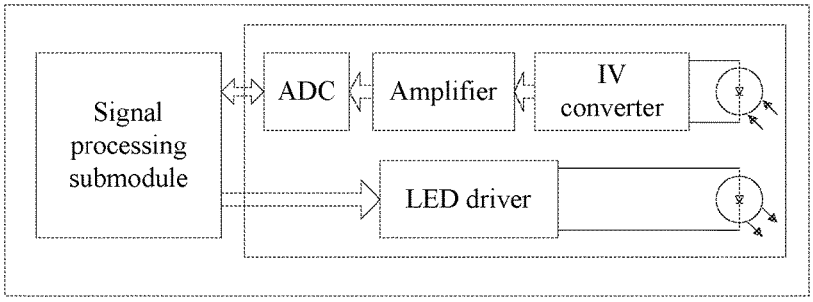
FIG. 15 is a schematic structural diagram of a biological features detection module according to Embodiment 15 of the present disclosure.

FIG. 15 is a schematic structural diagram of a biological features detection module according to Embodiment 15 of the present disclosure. As illustrated in FIG. 15, in this embodiment, using heart rate detection as an example, the biological features detection module 105 includes a signal processing submodule 115 and a sensor module 125. The sensor module 125 includes: an LED light source configured to irradiate a detected region of a user, an LED driver configured to drive the light source to emit light, a photoelectric converter configured to receive an optical signal reflected by the detected region and convert the optical signal into a current signal, an IV converter configured to convert the current signal into a voltage signal, and an ADC configured to process the voltage signal.

In this embodiment, an amplifier configured to amplify signals output by the IV converter may be added before the ADC.

The signal processing submodule 115 may judge a heart rate parameter of a tested object according to the regular variation of the strength of the reflected light, such that the biological features detection module 105 supports the heart rate detection function.

In conclusion, in the above embodiments of the present disclosure, since the Type-C interface not only supports analog communication, but also supports digital communication and analog-digital hybrid communication, no dedicated headphone socket is needed during practice of biological features detection using the headphone; instead, the Type-C interface may be directly used, which optimizes extensibility of the headphone. Biological features detection based on digital communication, analog communication and analog-digital hybrid communication may be implemented by pairing the Type-C interface and the smart terminal. In addition, since no dedicated circular headphone socket is needed, the Type-C interface of the terminal such as the mobile phone may be multiplexed, one interface of the terminal is capable of supporting external headphones, charging and data transmission simultaneously and may be extended to such interfaces as an audio accessory/VGA/HDM/DP or the like. If an adapter is equipped, the Type-C interface may further support previous-generation interfaces such as USB3.0, USB2.0 and the like.

The apparatus according to the embodiments of the present application may be practiced by a computer program. A person skilled in the art should understand the above division of units and modules is only an exemplary one, and if the apparatus is divided into other units or modules or not divided, the technical solution shall also fall within the protection scope of the present application as long as the information object has the above functions.

A person skilled in the art shall understand that the embodiments of the present application may be described to illustrate methods, apparatuses (devices), or computer program products. Therefore, hardware embodiments, software embodiments, or hardware-plus-software embodiments may be used to illustrate the present application. In addition, the present application may further employ a computer program product which may be implemented by at least one non-transitory computer-readable storage medium with an executable program code stored thereon. The non-transitory computer-readable storage medium comprises but not limited to a disk memory, a CD-ROM, and an optical memory.

The present disclosure is described based on the flowcharts and/or block diagrams of the method, apparatus (device), and computer program product. It should be understood that each process and/or block in the flowcharts and/or block diagrams, and any combination of the processes and/or blocks in the flowcharts and/or block diagrams may be implemented using computer program instructions. These computer program instructions may be issued to a computer, a dedicated computer, an embedded processor, or processors of other programmable data processing device to generate a machine, which enables the computer or the processors of other programmable data processing devices to execute the instructions to implement an apparatus for implementing specific functions in at least one process in the flowcharts and/or at least one block in the block diagrams.

These computer program instructions may also be stored a non-transitory computer-readable memory capable of causing a computer or other programmable data processing devices to work in a specific mode, such that the instructions stored on the non-transitory computer-readable memory implement a product comprising an instruction apparatus, where the instruction apparatus implements specific functions in at least one process in the flowcharts and/or at least one block in the block diagrams.

These computer program instructions may also be stored on a computer or other programmable data processing devices, such that the computer or the other programmable data processing devices execute a series of operations or steps to implement processing of the computer. In this way, the instructions, when executed on the computer or the other programmable data processing devices, implement the specific functions in at least one process in the flowcharts and/or at least one block in the block diagrams.

Although the preferred embodiments of the present application are described above, once knowing the basic creative concept, a person skilled in the art can make other modifications and variations to these embodiments. Therefore, the appended claims are intended to be construed as covering the preferred embodiments and all the modifications and variations falling within the scope of the present application. Obviously, a person skilled in the art can make various modifications and variations to the present application without departing from the spirit and scope of the present application. In this way, the present application is intended to cover the modifications and variations if they fall within the scope of the appended claims of the present application and equivalent technologies thereof.

What is claimed is:

1. A headphone, comprising:

a Type-C interface;

a controller electrically connected to the Type-C interface;

a biological features detection module connected to the controller;

a microphone electrically connected to the controller; and a loudspeaker electrically connected to the controller, wherein the loudspeaker is electrically connected to left and right sound channels;

wherein the biological features detection module is configured to detect biological features of a user wearing the headphone; the controller is configured to control, when the headphone is in a digital mode, paring between the Type-C interface and a terminal and communication among the terminal, the biological features detection module, the microphone and the loudspeaker, to control detection of biological features and processing of audio or video data;

the microphone is multiplexed to supply power to the biological features detection module, and to carry out uplink communication for uploading biological features data detected by the biological features detection module to the terminal; and the left and right sound channels are multiplexed to carry out downlink communication including sending control instructions from the terminal to the biological features detection module.

2. The headphone according to claim 1, further comprising a codec module; wherein the codec module is configured to communicate with the controller via a first digital channel, and is configured to process audio and video analog signals and process audio and video digital signals; the controller is configured to communicate with the biological features detection module by the first digital channel, to control detection of biological features.

3. The headphone according to claim 1, wherein the controller is configured to communicate with the biological features detection module via a second digital channel to control detection of the biological features and processing of audio and video data; the headphone further comprises a codec module configured to communicate with the controller by the second digital channel and process audio and video analog signals and process audio and video digital signals.

4. The headphone according to claim 3, wherein the Type-C interface comprises a first pin, wherein the first pin is electrically connected to the controller and is configured to supply power to the controller, the biological features detection module, the microphone and the loudspeaker.

5. The headphone according to claim 3, wherein the Type-C interface comprises a second pin, wherein the second pin is electrically connected to the controller and is configured to carry out communication if paring is performed between the headphone and a terminal using the headphone.

6. The headphone according to claim 3, wherein the Type-C interface comprises a third pin, wherein the third pin is electrically connected to the biological features detection module and is configured to supply power to the biological features detection module and the codec module.

7. The headphone according to claim 3, wherein the Type-C interface comprises a plurality of fourth pins, wherein the fourth pins are electrically connected to the controller and is configured to carry out communication between the Type-C interface and the biological features detection module, the microphone and the loudspeaker.

8. The headphone according to claim 1, further comprising a codec module; wherein the codec module is configured to communicate with the controller via a first digital channel, and is configured to process audio and video analog signals and process audio and video digital signals; and the controller is configured to communicate with the biological features detection module, via a second digital channel, to control detection of biological features and processing of audio and video data.

9. The headphone according to claim 1, further comprising an analog channel; wherein the controller is electrically connected to the biological features detection module, the microphone and the loudspeaker via the analog channel, to control detection of biological features and processing of audio and video data.

10. The headphone according to claim 9, further comprising a multiplexing switch configured to control the biological features detection module, the microphone and the loudspeaker to multiplex the same analog channel.

11. The headphone according to claim 10, wherein a signal wire corresponding to the microphone is multiplexed to supply power to the biological features detection module, and carry out uplink communication of the biological features detection module; left and right sound channel wires corresponding to the loudspeaker are multiplexed to carry out downlink communication of the biological features detection module.

12. The headphone according to claim 9, wherein the Type-C interface comprises a fourth pin and a fifth pin, wherein the fourth pin and the fifth pin are respectively pulled down to the ground via a first pull-down resistor and a second pull-down resistor, such that the headphone is in an analog mode.

13. The headphone according to claim 9, wherein the Type-C interface comprises a plurality of sixth pins, wherein the sixth pins are connected to the analog channel via the controller and are configured to carry out communication between the Type-C interface and the biological features detection module, the microphone and the loudspeaker.

14. The headphone according to claim 1, wherein the headphone further comprises an analog channel, wherein the controller is electrically connected to the biological features detection module, the microphone and the loudspeaker via the analog channel, to control detection of biological features and processing of audio and video data;

the headphone further comprises a codec module, wherein the codec module is configured to communicate with the controller via a first digital channel, and is configured to process audio and video analog signals and process audio and video digital signals; and the controller is configured to communicate with the biological features detection module by the first digital channel, to control detection of biological features; and the headphone further comprises a switching module configured to switch to detect biological features and process audio and video data by the analog channel or the first digital channel.

15. The headphone according to claim 1, wherein the headphone further comprises an analog channel, wherein the controller is electrically connected to the biological features detection module, the microphone and the loudspeaker via the analog channel, to control detection of biological features and processing of audio or video data; and the controller is configured to communicate with the biological features detection module via a second digital channel, to control detection of biological features and processing of audio or video data;

the headphone further comprises a codec module, wherein the codec module is configured to communicate with the controller by the second digital channel and is configured to process audio or video analog signals and process audio or video digital signals; and the headphone further comprises a switching module, wherein the switching module is configured to switch to detect biological features and process audio or video data by the analog channel or the second digital channel.

16. The headphone according to claim 1, wherein the headphone further comprises a codec module, wherein the codec module is configured to communicate with the controller via a first digital channel, and is configured to process audio or video analog signals and process audio or video digital signals; and the controller is configured to communicate with the biological features detection module via a second digital channel, to control detection of biological features and processing of audio or video data;

the headphone further comprises an analog channel; wherein the controller is electrically connected to the biological features detection module, the microphone and the loudspeaker via the analog channel, to control detection of biological features and processing of audio or video data; and the headphone further comprises a switching module, wherein the switching module is configured to switch to detect biological features and process audio or video data by the analog channel or the first or second digital channel.

17. The headphone according to claim 1, wherein the biological features detection module comprises a signal processing submodule and a sensor module, wherein the sensor module is configured to detect the biological features, and the signal processing submodule is configured to acquire the detected biological features and process the acquired biological features.

18. The headphone according to claim 17, further comprising a logic and time-sequence control module configured to perform time-sequence control on the sensor module and the signal processing submodule.

19. The headphone according to claim 17, the sensor module further comprises: a light source configured to irradiate a detected region, a driver configured to drive the light source to emit light, a photoelectric converter configured to receive an optical signal reflected by the detected region and convert the optical signal into a current signal, a current-voltage converter configured to convert the current signal into a voltage signal, and a processor configured to process the voltage signal.

20. An interaction system, comprising a smart terminal and a headphone; wherein processing of audio and video data and detection of biological features by a biological features detection module in the headphone are triggered by connecting a Type-C interface in the headphone to the smart terminal, the headphone comprising:

the Type-C interface;

a controller electrically connected to the Type-C interface;

the biological features detection module connected to the controller;

a microphone electrically connected to the controller, and a loudspeaker electrically connected to the controller, wherein the loudspeaker is electrically connected to left and right sound channels;

wherein the biological features detection module is configured to detect biological features of a user wearing the headphone; the controller is configured to control, when the headphone is in a digital mode, paring between the Type-C interface and a terminal and communication among the terminal, the biological features detection module, the microphone and the loudspeaker, to control detection of biological features and processing of audio and video data, the microphone is multiplexed to supply power to the biological features detection module, and to carry out uplink communication for uploading biological features data detected by the biological features detection module to the terminal; and the left and right sound channels are multiplexed to carry out downlink communication including sending control instructions from the terminal to the biological features detection module.

* * * * *